US005743160A

United States Patent [19]

Park

[11] Patent Number: 5,743,160

[45] Date of Patent: Apr. 28, 1998

[54] METALLIC TAPE CUTTING DEVICE

[75] Inventor: Youngkook Park, Kyungki-do, Rep. of Korea

[73] Assignee: Samsung Display Devices Co., Ltd., Kyungki-do, Rep. of Korea

[21] Appl. No.: 665,102

[22] Filed: Jun. 13, 1996

[30] Foreign Application Priority Data

Sep. 25, 1995 [KR] Rep. of Korea ..... 95-31627

[51] Int. Cl.[6] ..... B26D 5/22

[52] U.S. Cl. ..... 83/276; 83/206; 83/222; 83/262

[58] Field of Search ..... 83/175, 206, 222, 83/276, 277, 257, 258, 262, 628

[56] References Cited

U.S. PATENT DOCUMENTS 4,651,609 3/1987 Dobring et al. ..... 83/628

4,753,145 6/1988 Bakersman ..... 83/628

4,890,524 1/1990 Brown et al. ..... 83/628

4,987,811 1/1991 Ikarashi et al. ..... 83/628

*Primary Examiner*—Maurina T. Rachuba

*Attorney, Agent, or Firm*—Christie, Parker & Hale, LLP

[57] ABSTRACT

A metallic tape cutting device is disclosed, including a driving device, a driving force transmitting device for a crank member in a crank motion and a fork member in a fluctuating motion by receiving rotational power from the driving device. A tape transferring device pressurizes a tape material through a link member which receives force from the crank member, at the same time forces the tape material to transfer to the state of pressurization. A tape cutting device receives force from the fork member and cuts the tape material transferred by an ascending and descending motion.

6 Claims, 5 Drawing Sheets

METALLIC TAPE CUTTING DEVICE

BACKGROUND

The present invention relates to a metallic tape cutting device, and more particularly to a device for cutting a lead(metallic tape) which electrically connects electrodes and stem parts with each other, which are provided in an electron gun of a cathode-ray tube.

Generally, a metallic tape cutting device includes a transferring part which clamps and transfers tape material and a cutting part which cuts the tape transferred from the transferring part.

The tape transferring part cannot cut the tape in regular lengths because a cylinder is used as a transferring device as well as a cutting device, therefore the position of the devices cannot be controlled.

This type has the problem of reduced productivity because nothing can be done while the cylinder is reversing.

SUMMARY

The present invention is made in an effort to solve the problem described above. It is an object of the invention to provide a metallic tape cutting device which can increase productivity and control cutting lengths.

In order to realize the object of the invention, the metallic tape cutting device includes a driving device;

means for moving a crank member in a crank motion and a fork member in a fluctuation motion by receiving rotational power from the driving device;

a tape transferring device which pressurizes a tape material and simultaneously allows the tape material to transfer the state of pressurization through a link member which receives force from the crank member; and a tape cutting device for cutting the tape material which receives force from the fork member and is transferred with an ascending and descending motion.

Also, the metallic tape cutting device supplies the means for movement which includes a rotatable wheel, a slider connected with the crank member so that the crank angle can be variable at the side of the wheel, and a screw penetrating this slider by a screw combination so that this slider can be variable for the place of the wheel.

Also, the metallic tape cutting device supplies the tape transferring device which includes the link member which transmits force from the crank member, and as it starts rotation, pressurizes the tape material; the slider is combined with this link member and a guide guiding this slider.

Also, the metallic tape cutting device supplies the tape cutting device which includes a cutter connected with a fork member and a die which is fixed facing this cutter and the tape material is lifted.

The tape transferring device further comprises the metallic tape cutting device to include a roller group, which contains a multitude of rollers arranged above and below, that guides the tape material and keeps it flat.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DESCRIPTION

Figure 1:
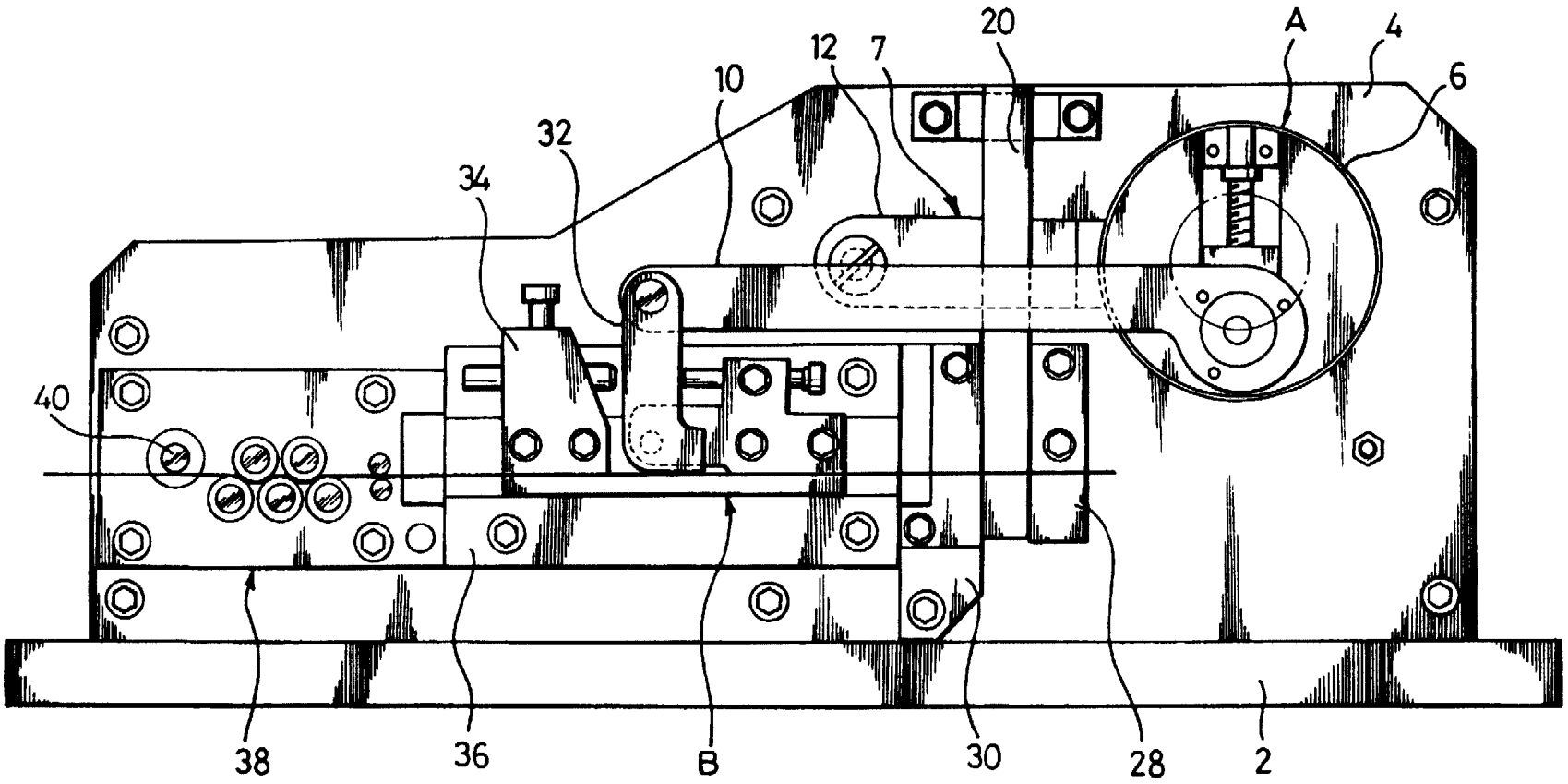
FIG. 1 is a front view of a cutting device according to a preferred embodiment of the present invention.

A preferred embodiment of the present invention will now be described in detail with reference to the accompanying drawings.

Certain terminology will be used in the following description for convenience and reference only and will not be limiting. The words "right" and "left" will designate directions in the drawings to which reference is made.

Figure 2:
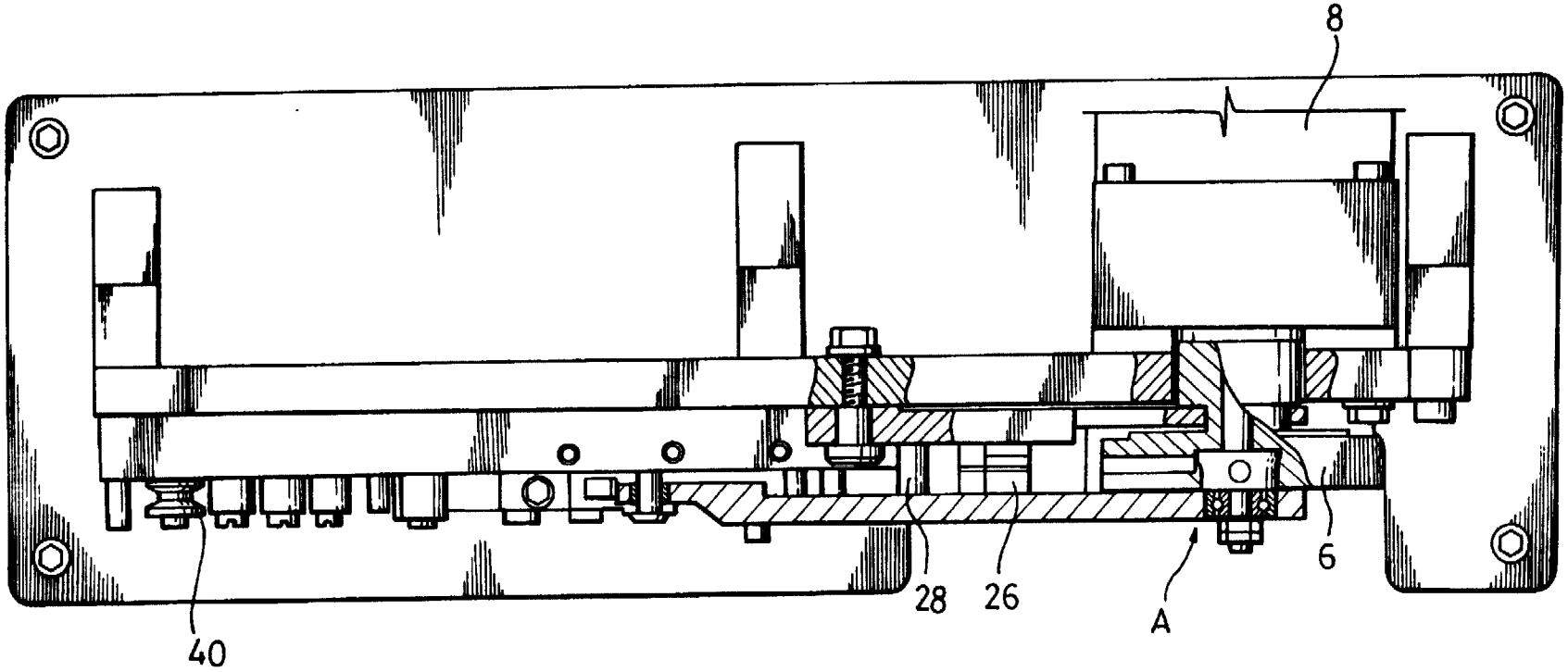
FIG. 2 is a plan view of a cutting device according to a preferred embodiment of the present invention.

FIGS. 1 and 2 are respectively front and plane views of a cutting device of the present invention, in which a vertical member 4 is fixedly mounted on a base member 2.

A driving force transmitting mechanism A provided on the vertical member 4 so that it can operate with a driving device 8 like a motor.

The driving device 8 is fixed firmly to the backside of the vertical member 4 through a bolt-like fastener.

The driving force transmitting mechanism A includes a wheel member 6 which is formed basically in a disk-shape, and a crank member 10 which is connected with the front side of the wheel member so that it can convert rotational driving force into rectilineal motion and transmit it to a tape transferring device B.

And the back side of the wheel member 6 is connected with the fork member 12 so that it can convert driving force into a rectilineal motion and transmit it to the tape cutting device 7.

The wheel 6 of the driving force transmitting mechanism A is provided with a slide groove 14 on its front side so that a slider 16 can move straight into this groove.

Figure 3:
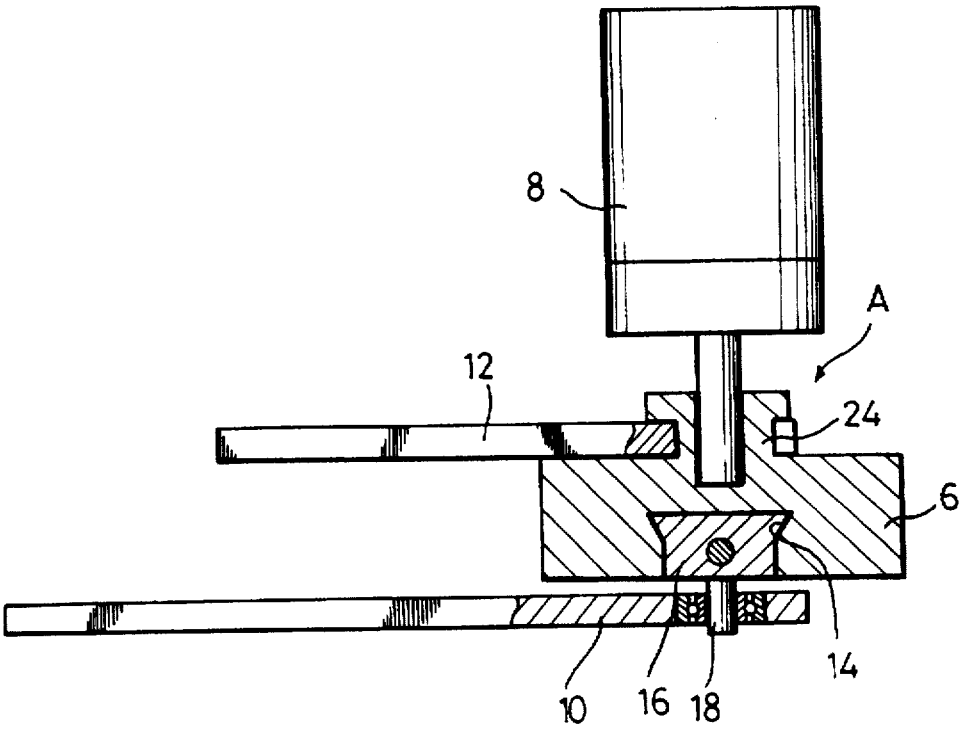
FIG. 3 is a front view of a displacement generating part of a cutting device according to a preferred embodiment of the present invention.
Figure 4:
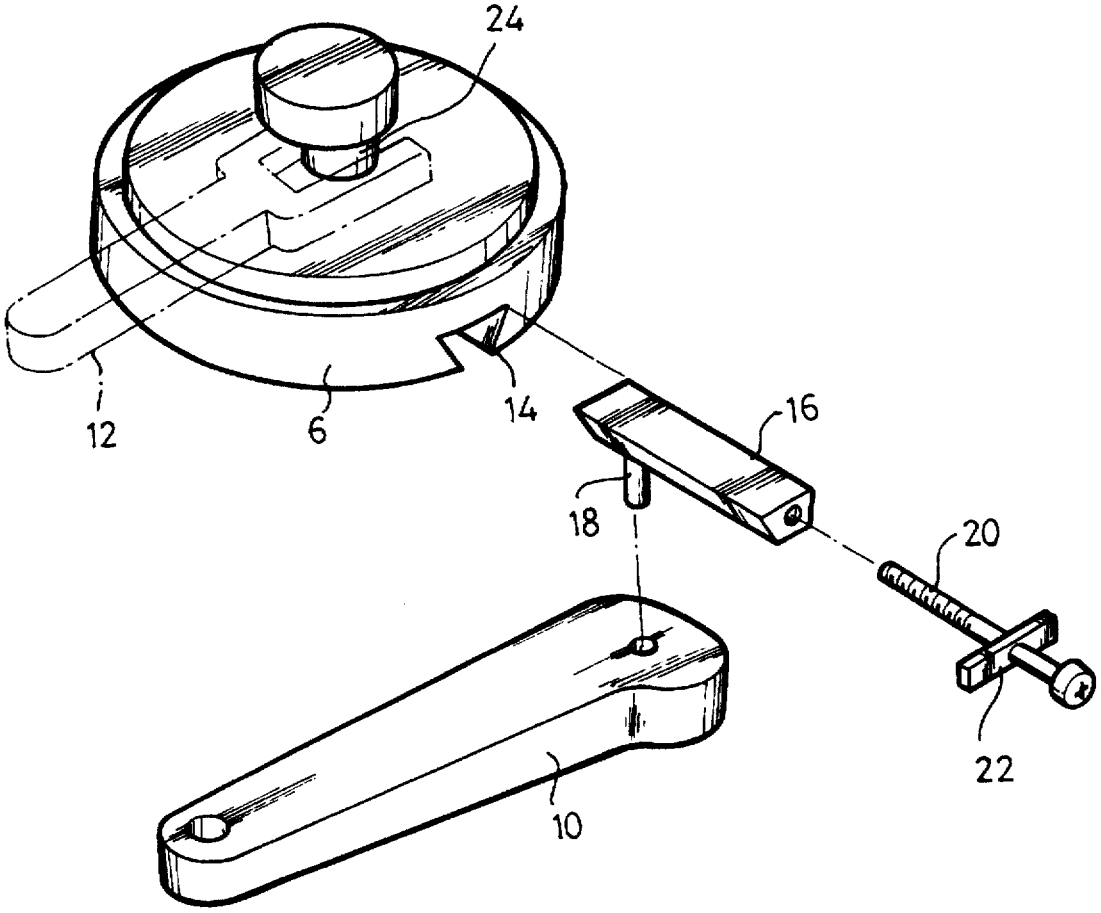
FIG. 4 is an exploded perspective view illustrating a driving device of a transfer part according to a preferred embodiment of the present invention.

On this slider 16 is fixed a pin member 18 as illustrated in FIGS. 3 and 4. The crank member 10 is connected with this pin member so that it can transmit power thereto.

The slider 16 includes a screw 20 which penetrates its center through a screw combination and the screw 20 is stuck to a projection 22 formed on the wheel, so that it is restricted in its motion toward the direction of length and accordingly moves only toward the direction of the circumference.

This constitution permits the screw 20 to move the slider 16 forward or backward when the screw 20 rotates.

In FIG. 4, the projection 22 is illustrated independently, however it is fixed nearby to the slide groove 14 of the wheel 6.

Accordingly, when the wheel 6 rotates, the slider 16 which is disposed on the wheel 6 rotates together therewith. At this time, the moving angle of the crank member 10 is changed according to the location of the slider.

Namely, the more the place of the pin member 18 of the slider 16 is moved toward the center of the wheel 6, the smaller the crank angle, and the more the pin member is displaced toward the circumference of the wheel 6, the bigger the crank angle.

As illustrated in FIGS. 3 and 4, the cam member 24 is integrally formed with the backside of the wheel 6 to be off-centered with this wheel. A fork member 12 is connected with the cam member.

The fork member 12 has a coupling part that is fork-shaped so as to be connected with the cam member 24.

Figure 5:
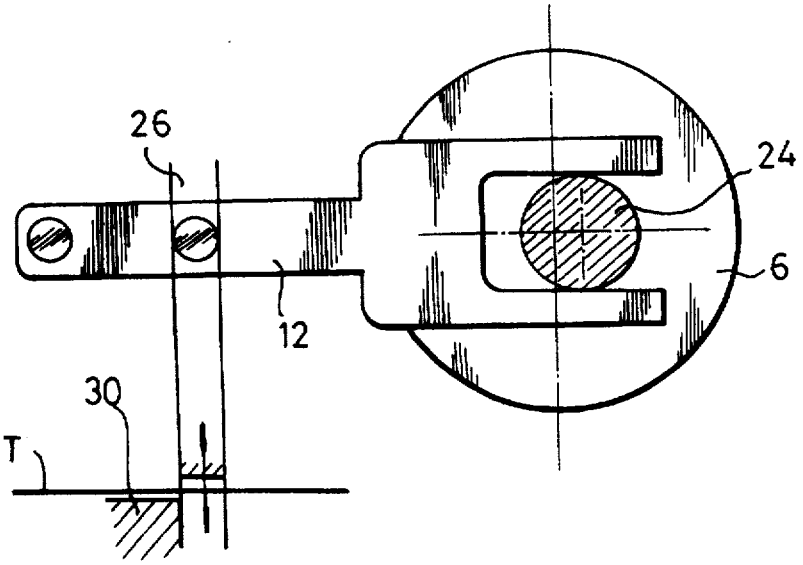
FIG. 5 is a plane view illustrating a driving device of a cutting part according to a preferred embodiment of the present invention.

As illustrated in FIG. 5, by the connection of the wheel 6 and the fork member 12, when the wheel starts rotation, the fork member starts to fluctuate according to the cam diagram of the cam member This fluctuation appears as an up and down motion in the state that the wheel is stood. However, the fluctuating motion is able to be realized by a vertical section part of the fork member 12 being made of a hinge combination at the vertical member 4.

A cutter 26 is connected with the fork member 12, such that this cutter 26 can ascend and descend while being guided by the guide 28.

The lower end of the cutter 26 can ascend and descend, while face-contacting the die 30 fixed at the vertical member 4, and upon the this die 30, tape material T is supplied.

Figure 6:
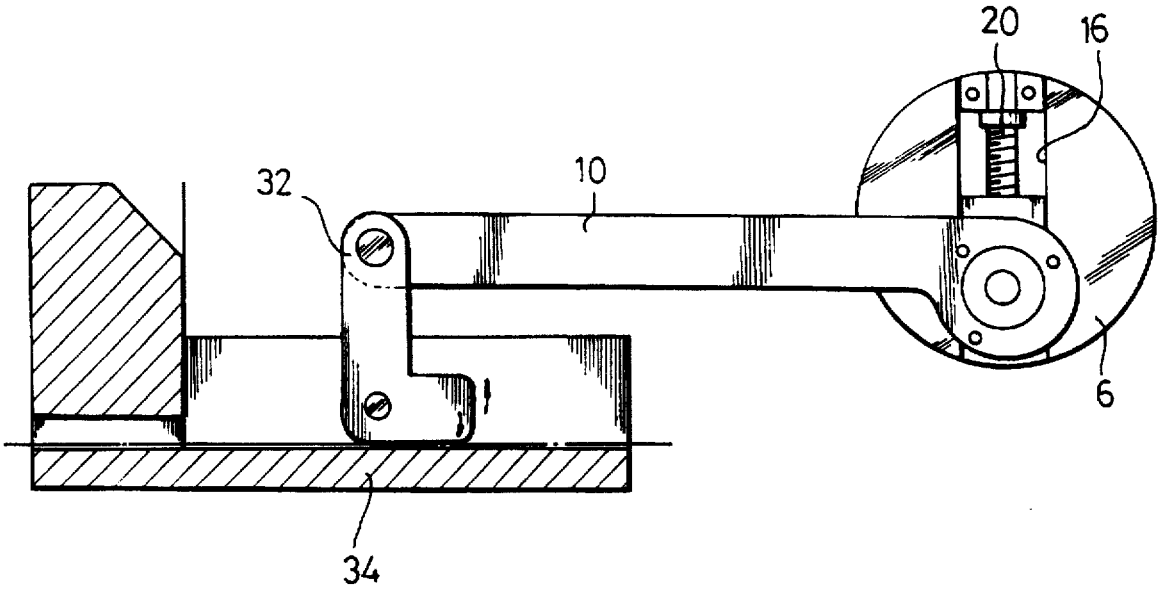
FIG. 6 is a front view illustrating a tape transfer part according to a preferred embodiment of the present invention.

FIG. 6 describes the tape transferring device in detail, where one end of the crank member 10 is connected with the slider 34 through the link member 32.

The upper end of the link member 32 is connected, through a hinge-combination, with the crank member 10, and the lower end of the link member is connected to the slider 34 through a hinge-combination.

The slider 34 is provided with a pathway through which the tape material T can pass. The lower end of the link member 32 is placed on this pathway, so that it can apply or release pressure to the tape material T according to the crank motion of the crank member 10.

The slider 34, as illustrated in FIG. 1, is placed at the upper side of the guide fixed at the vertical member 4 so that it can slide toward the left and right.

Accordingly, when the crank member 10 starts the crank motion, the link member 32 starts a circular motion and presses the tape material, but because the displacement in the direction of the circumference of the link member is small, it cannot absorb the crank motion.

Accordingly, because this crank motion is transmitted towards the slider again, and it permits this slider to move to the left and right, if it is in a state where the link member is pressing the tape material, the tape material is moved to the right; if it is in a state where link member is releasing the press, the movement of the tape is completed and the slider is ready to be reversed.

In the left side of the tape transferring device B, a roller group, composed of a plurality of rollers for guiding the tape material and spreading it flat is supplied.

A first roller 40 of this roller group 38 is an approach roller, structured like a pulley with a V-groove formed in the direction of the circumference thereof, and the following rollers are cylindrical rollers which are arranged above and below the path of the tape.

The following describes how the tape cutting device operates when in use. First, when the tape material T approaches the approach roller, penetrates the roller group 38 and is transferred to the entrance of the transferring device, the driving device 8 starts to drive. And how the tape is transferred and cut, and how the amount of tape being transferred is controlled will be described hereinafter.

Namely, if the driving device 8 starts to drive, the wheel 6 starts to rotate. At this point, since the wheel 6 is connected with the crank member 10 through the slider 16 which is connected with the fork member 12 through the cam member 24, the right ends of the crank and fork members move up and down centering around with the left ends which are combined with the vertical member 4 in a hinge combination.

At this time, the power transmitted through the crank member 10 is transmitted through the link member 32 and allows this link member to rotate in the circumferential direction. At this point, the front end of the tape material is placed between the lower end of this link member 32 and a pathway of the slider 34, the tape material is pressurized between the link member and the slider 34.

At the same time, when the crank member 10 further operates in the crank angular motion, the slider 34 is moved by accepting a movable power in the right direction through the link member 32.

At this time, because the slider 34 moves according to the guide 36, the tape material T moves as much as the transferring extent of the slider.

By the rotational motion of the wheel 6, the right end of the fork member 12 moves up and down centering around its left end which is combined with the vertical member in the hinge combination. The cutter 26, connected to the fork member, also moves up and down together.

In addition, the cutter 26 ascends when the tape material moves to the right and descends when the transmission of tape material is finished so that the tape material is cut.

Figure 7:
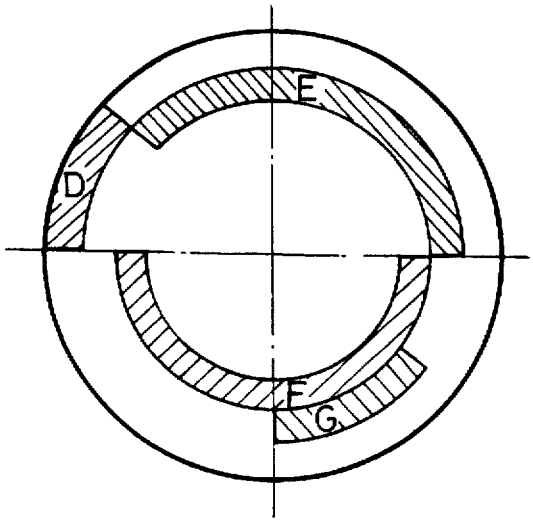
FIG. 7 is a view representing functions of each part of a wheel according to a preferred embodiment of the present invention.

This timing can be adjusted in accordance with the position of the slider disposed in the slide groove 14 of the wheel as well as the cam diagram of the cam member 24 which is integrally formed with the wheel 6. The control of the timing is roughly like that shown in the timing diagram of FIG. 7.

The point of time that the tape material T is pressurized by the link member 32 corresponds to section D. Furthermore, after the pressurization of the material has been finished, in a section E, the slider is completely moved; and after the movement of the slider has been finished, in a section F, the slider 34 returns to its original place, therefore the tape material is cut by the descent of the cutter 26.

At this time, as there is time while the cutter starts to descend, after the slider 34 starts to reverse, the tape is cut in a G section. Because this G section lasts for only a moment, the slider 34 starts its ascent before it is completely finished reversing.

The slider 16, placed so as to be slidable at the wheel of the driving force transmitting part A of the present invention moves with respect to the wheel by the rotation of the screw 20. This lets the crank motion of the crank member 10 to be large or small, thereby adjusting the movable distance of the slider 34 connected through the link member 32.

This is convenient for cutting leads in a suitable length as in the case of the leads connected between electrodes of an electron gun and the stem part of cathode-ray tubes need to be different in their lengths.

What is claimed is:

1. A metallic tape cutting device comprising:

a driving device for providing rotational power;

means for moving a crank member in a crank motion and a fork member in a fluctuation motion by receiving the rotational power from the driving device;

a tape transferring means which pressurizes tape material through a link member receiving force from the crank member, the link member thereby causing the pressurized tape material to be transferred;

a tape cutting means which receives force from the fork member and cuts the tape material transferred from the tape transferring means by an ascending and descending motion.

2. The metallic tape cutting device of claim 1, wherein the means for moving comprises:

a rotatable wheel;

a slider connected with the crank member so that a moving angle of the crank can be changed at one end of the wheel; and a screw which penetrates the slider by a screw combination so that the placing of the slider can be changed on the wheel.

3. The metallic tape cutting device of claim 1, comprising a slider cooperating with the link member and a guide which guides the slider.

4. The metallic tape cutting device of claim 1, wherein the tape cutting device comprises a cutter which is connected to the fork member; and a die which is fixed opposite to the fork member.

5. The metallic tape cutting device of claim 1, wherein the tape transferring device comprises a roller group which comprises a plurality of rollers arranged above and below which guides the tape material and keeps the tape flat.

6. The metallic tape cutting device of claim 1 wherein the means for moving comprises a rotatable wheel having mounted thereon an off-center cam, and wherein the fork member comprises a forked end which engages said off-center cam.

* * * * *